US005290116A

United States Patent [19]

Chang

[11] Patent Number: 5,290,116

[45] Date of Patent: Mar. 1, 1994

[54] FLOW CONTROL FOR WRITING INSTRUMENTS

[76] Inventor: Shin-Ju D. Chang, P.O. Box 1383, South Pasadena, Calif. 91301

[21] Appl. No.: 903,132

[22] Filed: Jun. 23, 1992

[51] Int. Cl.[5] ..... B43K 5/18; B43K 7/10; B43K 8/06

[52] U.S. Cl. ..... 401/199; 401/205; 401/219

[58] Field of Search ..... 401/198, 199, 205, 207, 401/219, 265, 297, 214–218, 220, 223, 225, 229, 230, 198, 199; 401/214–218, 220, 223, 225, 229, 230, 198, 199

[56] References Cited

U.S. PATENT DOCUMENTS

| | | | |
|---|---|---|---|
| 2,140,009 | 12/1938 | Hand | 401/199 |
| 3,922,100 | 11/1975 | Saito | 401/199 |
| 4,057,354 | 11/1977 | Bajusz et al. | 401/199 |
| 4,588,319 | 5/1986 | Niemeyer | 401/199 X |
| 4,671,692 | 6/1987 | Inaba | 401/199 |
| 4,770,558 | 9/1988 | Frietsch | 401/199 X |
| 4,973,182 | 11/1990 | Nakano | 401/199 |

FOREIGN PATENT DOCUMENTS

| | | | |
|---|---|---|---|
| 3816770 | 11/1989 | Fed. Rep. of Germany | 401/198 |

*Primary Examiner*—Danton D. DeMille
*Attorney, Agent, or Firm*—Michael D. Bednarek

[57] ABSTRACT

An ink flow control mechanism is provided to prevent ink leakage or excessive ink discharge of a writing instrument particularly utilizing a capillary stick for delivering ink from an ink reservoir to a writing tip. A porous polytetrafluoroethylene (PTFE) membrane, which is permeable to moisture vapor and air molecules while performing hydrostatic resistance, is used to wrap a first portion of the capillary stick to prevent ink leakage to allow air to enter the ink reservoir to balance pressure drops. A foam is further used to wrap a second portion of the capillary stick. The ink flow rate can be adjusted by a selection of foams with different porosity density. The foam is in addition capable of absorbing an extra amount of ink flowing into the capillary stick to prevent leakage.

19 Claims, 6 Drawing Sheets

FLOW CONTROL FOR WRITING INSTRUMENTS

BACKGROUND OF THE INVENTION

The present invention relates to writing instruments, and more specifically, to an improved ink flow control mechanism for use in combination with writing instruments utilizing capillary actions to discharge inks.

A U.S. Pat. No. 4,588,319 to Robert H. Niemeyer is particularly directed to a marking instrument capable of precisely controlling the flow rate of marking fluid from a marking fluid reservoir to a marking tip.

In addition, a U.S. Pat. No. 3,308,501 to Marsh describes a marking pen capable of providing a constant, uninterrupted flow of ink to the writing end of a wick and the rate of flow of ink to the writing end of the wick can be selectively controlled and varied as desired.

Other means capable of providing ink flow control functions include the provision of a series of spaced fins for absorbing excess ink. The spaced fins, however, require precision tools to manufacture and therefore manufacturing costs are very high.

SUMMARY OF THE INVENTION

It is an object of the present invention to provide an improved ink flow control mechanism used in combination with a writing instrument employing capillary actions for delivering inks from an ink reservoir to a writing tip.

It is another object of the present invention to provide an improved ink flow control mechanism which is versatile in adjusting ink flow rate, i.e. the ink flow rate can be preselectively controlled.

It is still another object of the present invention to provide an improved ink flow control mechanism which will prevent leakage of ink.

It is yet another object of the present invention to provide an improved ink flow control mechanism which is easy to manufacture and inexpensive.

In accordance with the object of the present invention, a hydrophobic membrane capable of allowing free passage of air while preventing transmission of fluids and aerosols is employed. Although the hydrophobic membrane is still highly porous, ink does not wick through the pores thereof because of low surface tension. The hydrophobic membrane is used to laminate portions of a hydrophilic material, such as a felt tip, so as to form a capillary stick. The thus formed capillary stick is capable of preventing ink leakage from the side surface thereof and allowing air from ambient atmosphere to enter into the capillary stick and subsequently into the ink reservoir to balance pressure drops caused by a discharge of inks out of the ink reservoir. The selection of a different porosity density for the hydrophobic membrane provides a different ink flow rate.

A foam is further used to laminate a second portion of the capillary stick. The ink flow rate can further be adjusted by a selection of foams with different porosity density. The foam in addition is able to function as a buffer zone capable of absorbing an extra amount of ink flowing into the capillary stick.

Compared with prior art writing instruments having ink flow control functions, the ink flow control mechanism in accordance with the present invention is particularly effective in ink flow control and much easier. to manufacture.

BRIEF DESCRIPTION OF THE DRAWINGS

The present invention can be more fully understood by reading the subsequent detailed description of the preferred embodiments thereof with references made to the accompanying drawings, wherein.

DETAILED DESCRIPTION OF THE PREFERRED EMBODIMENTS

The present invention of an ink control mechanism will be described hereinafter in this section by way of preferred embodiments used in combination with a rolling pen and a marker (marking pen). It should be understood that the present invention can be utilized in any writing instrument employing capillary actions for delivering ink. In combination with a different writing instrument, some minor structural modifications may be required to the ink flow control mechanism of the present invention.

Utilization in a Rolling Pen

Figure 1:
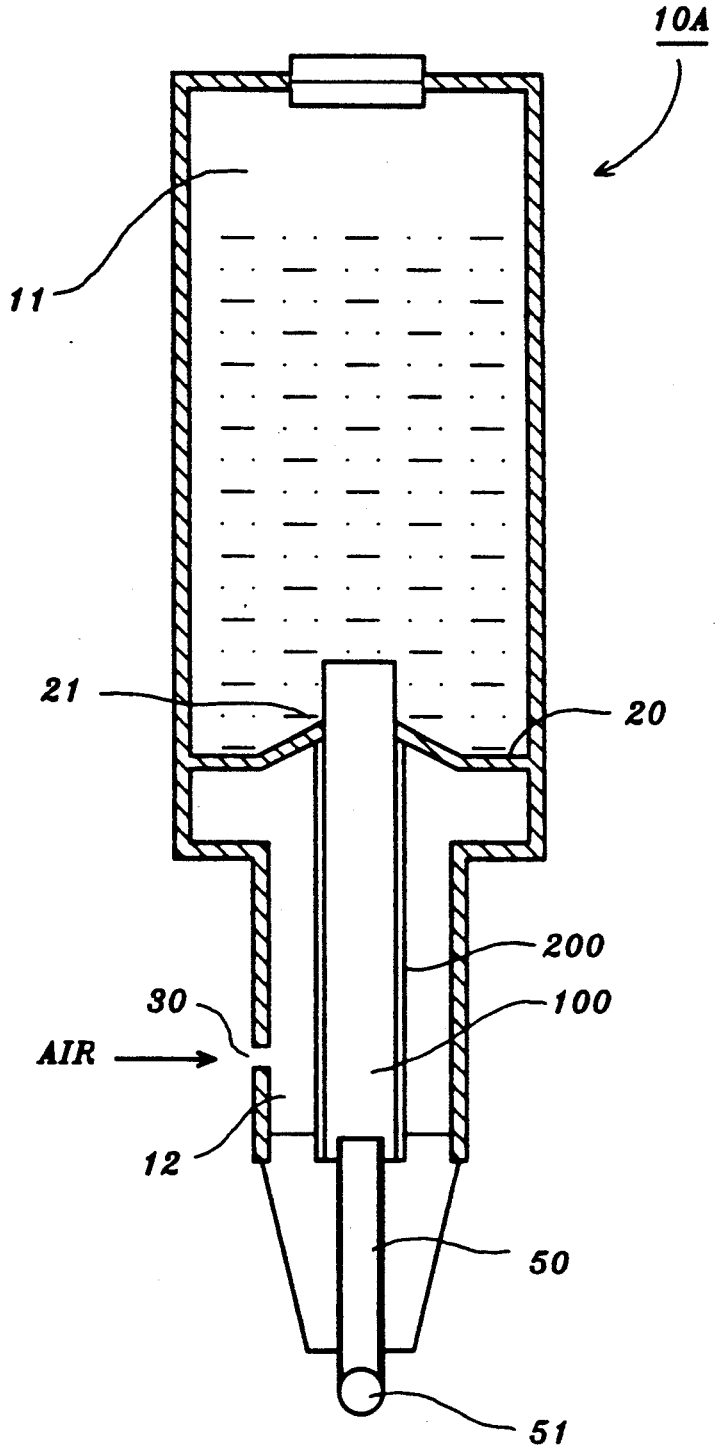
FIG. 1 is a longitudinal sectional view of a rolling pen.

Referring to FIG. 1, there is shown a rolling pen 10A provided with an ink flow control mechanism in accordance with the present invention. The interior space of the rolling pen 10A is divided by a baffle member 20 into two spaces, an upper space 11 and lower space 12. The upper space 11 is used as an ink reservoir for storing ink therein; and the lower space 12 is used to accommodate an ink flow control mechanism in accordance with the present invention.

The end of the capillary stick 100 is coupled to a rolling tip 50 which utilizes a ball point 51 for impressing ink onto a writing surface. The rolling tip 50 can be constructed in accordance with a pen tip structure disclosed in a U.S. Pat. No. 4,842,433 issued to Otsuda so that a detailed description thereof will be omitted.

The ink flow control mechanism includes capillary stick 100 which is made of fibrous mate such as the widely used felt. The peripheral surface of a portion of the capillary stick 100 that is disposed within the lower space of the rolling pen 10A is laminated with a membrane 200 made of hydrophobic materials.

The hydrophobic material can be selected from the group consisting of:

polypropylese,
polytetrafluoroethylene (PTFE),
expanded polytetrafluoroethylene (ePTFE),
ployvinylidenefluoride (PVDF),
acrylic/nylon, and
hydrophobic polysulfone.

The hydrophobic material has tiny pores capable of allowing moisture vapor to be permeated freely therethrough and while offering hydrostatic-resistance characteristics. Among the above listed materials, the PTFE is manufactured by Tetratec Corporation and trademarked as TETRATEX. And the ePTFE is manufactured by IMPRA.

The ink reservoir 11 is a hermetic space that communicates with the outside world only through the exit opening 21 of the baffle member 20. A vent 30 is provided such that the lower space 12 of the rolling pen 10A is in air communication with the ambient atmosphere.

Since ink fluid contained in the capillary stick 100 evaporates easily if the peripheral surface of the capillary stick 100 is exposed to the atmosphere, a membrane that is made of water-resistant materials (waterproof materials) should be used to wrap around the capillary stick 100. Furthermore, as the rolling pen 10A is being used in writing, ink is drawn constantly out of the ink reservoir 11 and thus a pressure drop is created within the ink reservoir 11. Since it is a characteristic of the capillary stick 100 that air molecules can travel through the pores thereof, it is required that air from the atmosphere be able to enter into the capillary 100 and subsequently into the ink reservoir in order to maintain a constant rate of ink flow.

The conventional membrane is not only water-resistant but is also impermeable to moisture vapor. As a consequence, using the conventional membrane to prevent ink evaporation would as well deteriorate ink flow rate. If a conventional membrane is used to wrap the capillary stick 100, air from the atmosphere is not able to enter through the conventional membrane into the pores of the capillary stick 100 and thus ink flow rate would be significantly low.

Consequently, it is an important aspect of the present invention to employ the hydrophobic materials listed above to make the membrane 200 such that ink fluid contained within the capillary stick 100 would not evaporate to the atmosphere.

Since the membrane 200 is available with a variety of tubing sizes and porosity densities, the ink flow rate through the capillary stick 100 can be adjusted by a selection of hydrophobic materials having different porosity densities.

If the membrane 200 is provided with a smaller porosity density, air molecules would flow therethrough in a more restrictive way into the capillary stick 100 and subsequently to the ink reservoir 11, thereby creating a smaller ink flow rate.

On the contrary, if the membrane 200 is provided with a larger porosity density, air molecules would flow therethrough in a more permeable way into the capillary stick 100 and subsequently to the ink reservoir 11, thereby creating a larger ink flow rate.

The rolling pen 10A of FIG. 1 provides excellent writing effects. However, under some conditions when the rolling pen 10A is subject to a sudden throw, an overflow of ink may take place within the capillary stick that causes ink leakage at the writing tip of the rolling pen 10A. To solve this problem, the rolling pen 10A is modified to incorporate a foam adjacent to the exit opening 21 of the ink reservoir. The modified rolling pen is designated by 10B and the description thereof will be made with references made to FIGS. 2–3.

Figure 3:
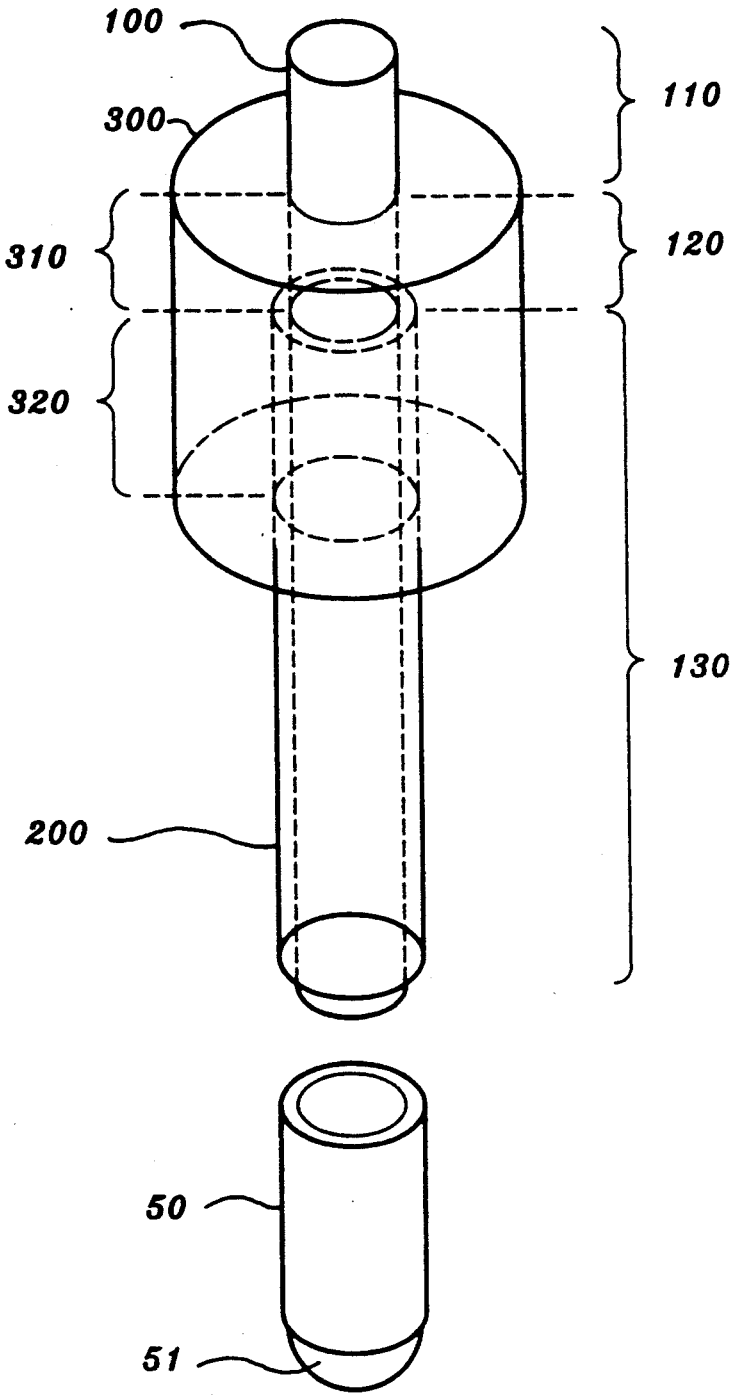
FIG. 3 shows an enlarged view of a capillary stick and a pen tip which are removed out of the rolling pen shown in FIG. 2.

Referring to FIG. 3, in the modified rolling pen 10B the capillary stick 100 is divided into three sections, a first section 110, a second section 120 and a third section 130. The third section 130 of the capillary stick 100 is wrapped w the membrane 200 made of hydrophobic material as in the rolling pen 10A of FIG. 1.

A foam 300 having a porosity density larger than that of the capillary stick 100 is provided to encompass the capillary stick 100 As shown with an enlarged view in FIG. 3, the foam 300 is arranged with a first portion 310 thereof in direct contact with the surface of the second section 120 of the capillary stick 100 and a second portion 320 thereof being extended longitudinally along the capillary stick 100 and covering part of the membrane 200.

Both of the second section 120 and the third section 130 of the capillary stick 100 are disposed within the lower space 12 of the rolling pen 10. The first section 110 of the capillary stick 100 is inserted through an exit opening 21 of the baffle member 20 into the ink reservoir 11 such that the foam 300 is in fluid communication with the ink stored in the ink reservoir 11. The end of the third section 103 of the capillary stick 100 is coupled to the rolling tip 50.

The foam 300 is provided with a porosity density larger than that of the capillary stick 100 and that of the membrane 200. As a consequence, the foam 300 has larger pores more permeable to air and moisture vapor than the capillary stick 100 and the membrane 200.

It is a conventional technique, as described in the U.S. Pat. No. 4,588,319 issued to Niemeyer that changing the porosity density of the foam 300 can be used to control the ink flow rate.

Since the second portion 320 of the foam 300 covers an upper portion of the membrane 200, i.e. the portion of the membrane 200 that is closer to the ink reservoir 11, it provides a further restrictive means for the air from the atmosphere to enter into the capillary stick 100 through the upper portion of the membrane 200. Therefore, ink flow rate can also be fine adjusted by a selection of different porosity density of the foam 300 and a selection of the extent of the second portion 320 of the foam 300 to cover the upper portion of the membrane 200.

In addition to the foregoing benefits provided by the foam 300, the employment of the foam 300 is directed mainly to be used to absorb excess ink to prevent ink leakage caused by an oversupply of ink to the rolling tip 50. There are occasions when ink may be overflowing in the capillary stick 100 due to a throw of the rolling pen 10A that causes an inertia force in the capillary stick 100.

To cope with this problem, the foam 300 is arranged with a portion 310 coming into direct contact with the capillary stick 100, i.e. with the second section 120 of the capillary stick 100 as shown in FIG. 3. This portion is selected to be adjacent to the exit opening 21 of the baffle member 20, i.e. right at the exit of ink from the ink reservoir 11.

Since the pores of the foam 300 are larger than that of the capillary stick 100, ink fluid would hardly cross the interface between the first portion 310 of the foam 300 and the second section 120 of the capillary stick 100 under normal operation when ink flow is only governed by capillary actions.

At the time when ink flow is subject to an external force, an extra amount of ink will flow out of the ink reservoir upon flowing out of the ink reservoir 11, the extra amount of ink encounters immediately the second section 120 of the capillary stick 100. As a consequence, the extra amount of ink, instead of being pushed all the way through the capillary stick 100 to the rolling tip 50, will be pushed to (absorbed by) the foam 300. The second portion 320 of the foam 300 which extends beyond the second section 120 of the capillary stick 100 acts therefore as a container for receiving the excessive ink.

Utilization in a Marking Pen

Figure 2:
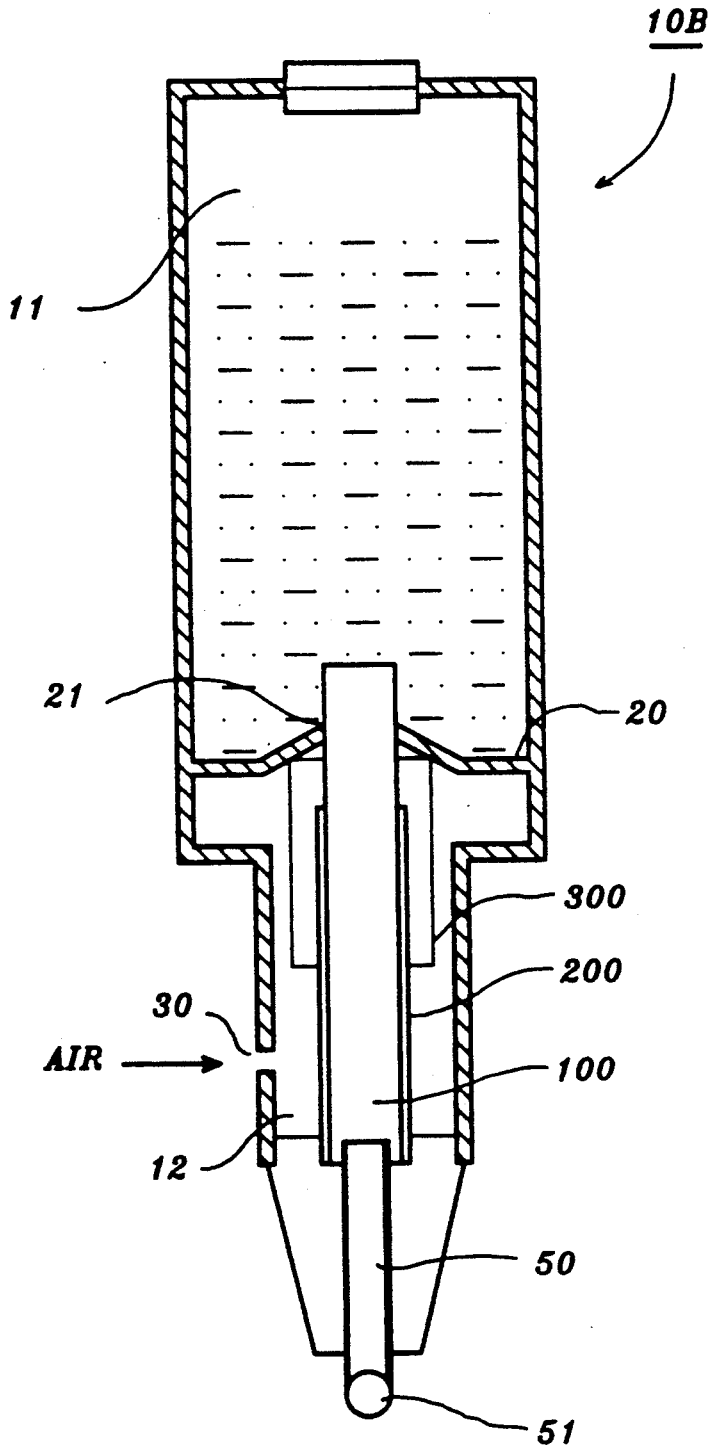
FIG. 2 is a longitudinal sectional view of another rolling pen.
Figure 4:
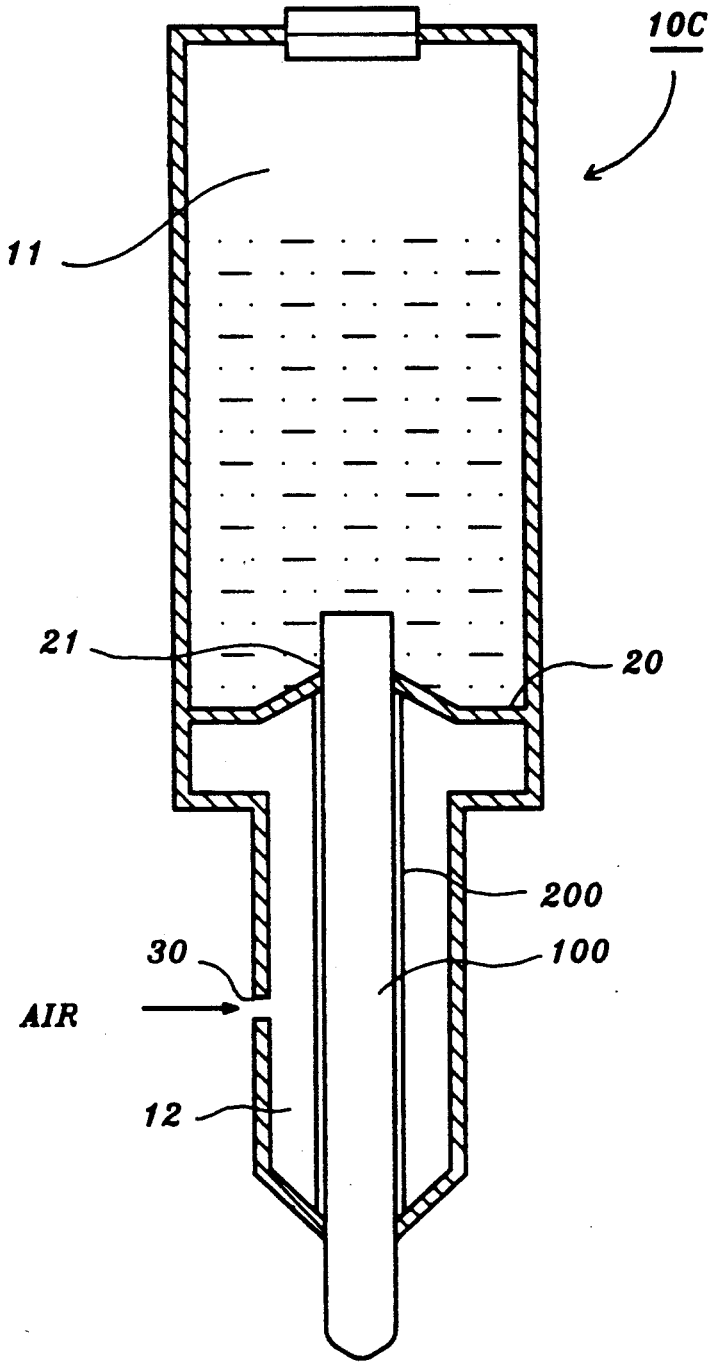
FIG. 4 is a longitudinal sectional view of a marking pen.
Figure 5:
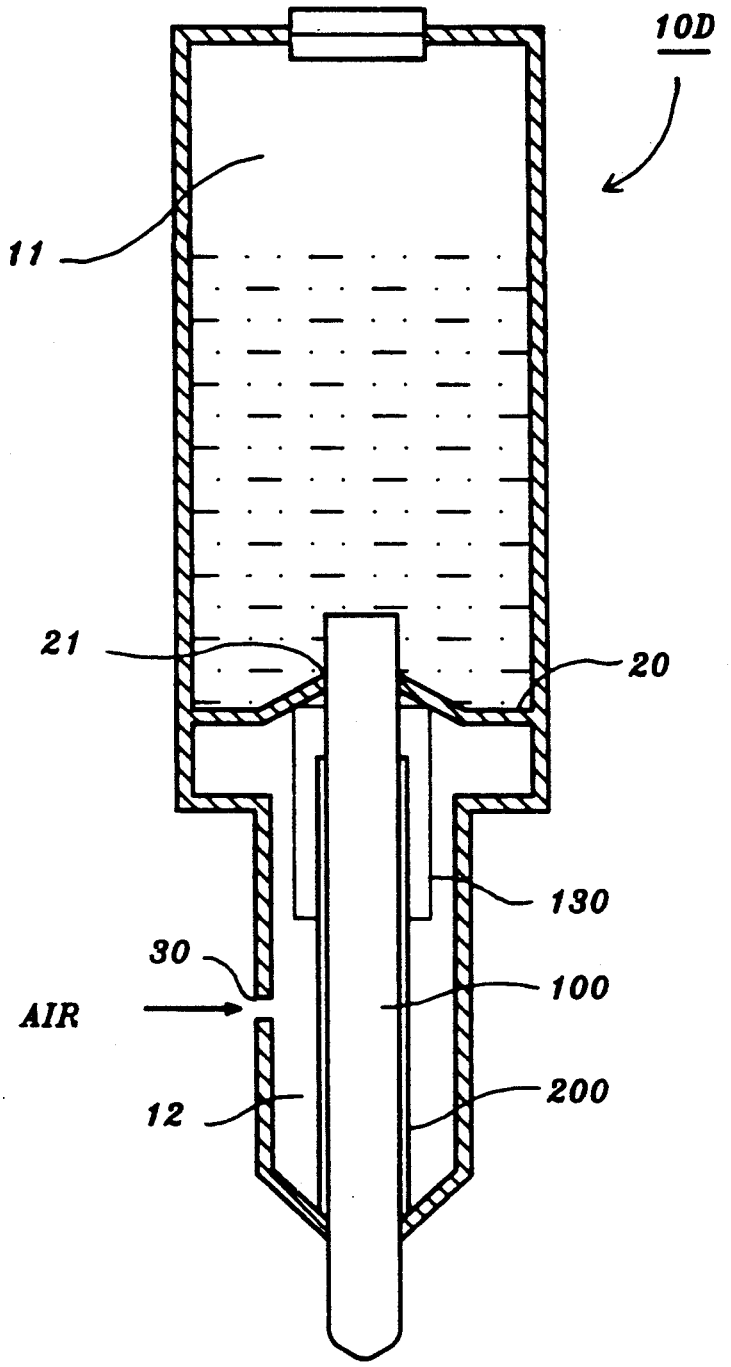
FIG. 5 is a longitudinal sectional view of another marking pen.
Figure 6:
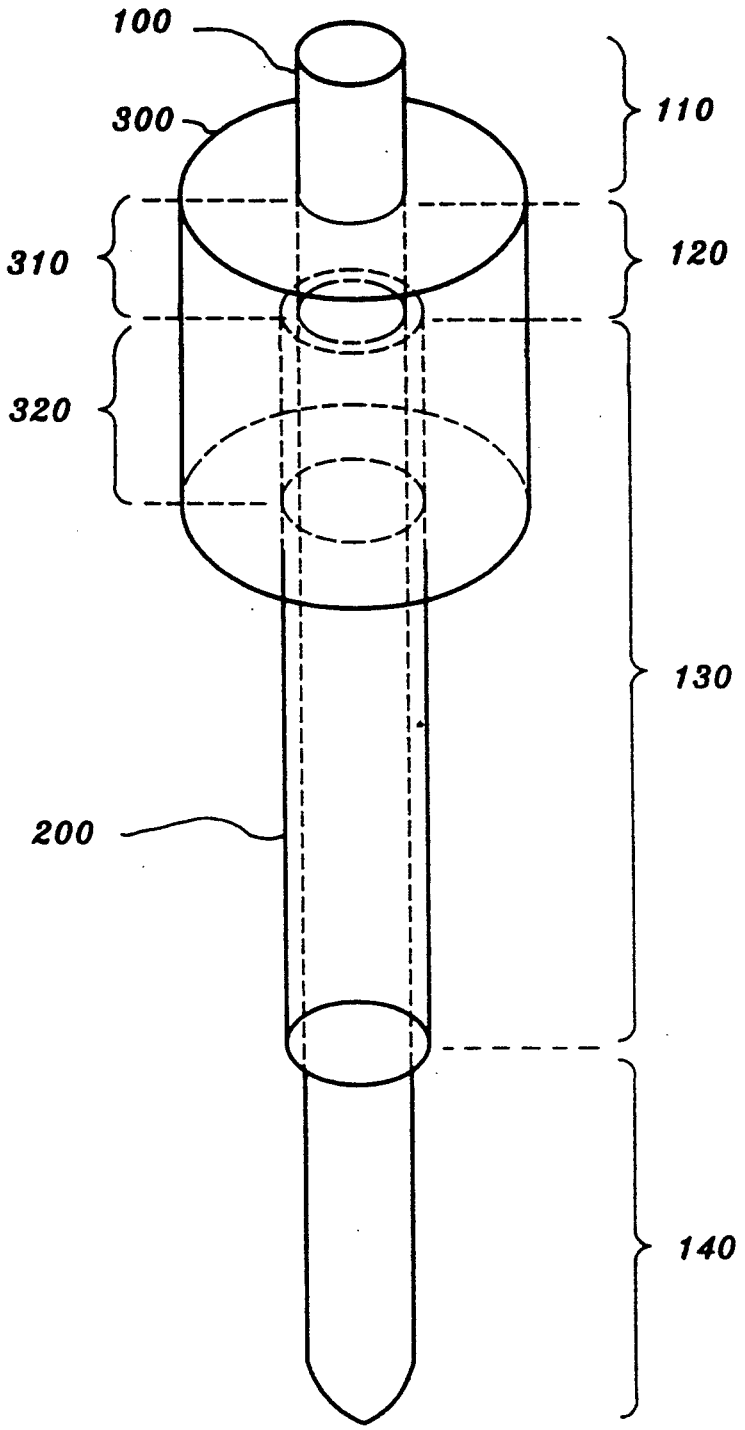
FIG. 6 shows an enlarged view of a capillary stick removed out of the marking pen shown in FIG. 5.

In FIGS. 4–6, elements that are not changed or modified in view of the rolling pen shown in FIGS. 1–3 are labeled with the same reference numerals.

Referring to FIG. 4, there is shown a marking pen 10C. The marking pen 10C differs from the rolling pen 10B shown in FIG. 1 only in that the rolling tip 50 of the rolling pen 10B is removed and the capillary stick 100 is elongated so that the elongated section is protruded out of the lower space 12 and used directly as a marking tip.

Referring to FIGS. 5–6, a marking pen 10D is shown with the incorporation of the foam 300. The marking pen 10D differs from the rolling pen 10B shown in FIG. 1 only in that the rolling tip 50 of the rolling pen 10B is removed and the capillary stick 100 is elongated to include a fourth section 140 disposed outside of the lower space 12 and used directly as a marking tip.

To manufacture highest quality writing instruments, the embodiments that are shown in FIG. 2 and FIG. 5 may be selected. However, to save manufacturing costs, the foam 300 may be removed to make writing instruments as the embodiments shown in FIG. 1 and FIG. 4. The thus manufactured writing instruments provide nonetheless good quality writing effects.

The present invention has been described hitherto with an exemplary preferred embodiment of a rolling pen and a marking pen. However, the ink flow control mechanism described above could be used in combination with any other writing instruments that utilize capillary actions for delivering inks. It is to be understood that the scope of the present invention need not be limited to the disclosed preferred embodiment. On the contrary, it is intended to cover various modifications which are within the scope of the following appended claims.

What is claimed is:

1. A writing instrument, comprising:
(a) an ink reservoir;
(b) a writing tip;
(c) a capillary member for delivering ink from the ink reservoir to the writing tip by means of capillary actions; and
(d) a layer of hydrophobic property material covering said capillary member, said hydrophobic layer having first and second ends and a first porosity density allowing transmission of air from the atmosphere through said hydrophobic layer intermediate said first and second ends and into said capillary member while retarding ink contained within said capillary member form passing therethrough. said first porosity density being selected with a predetermined value so as to control ink flow through said capillary member with a preselected rate.

2. A writing instrument as set forth in claim 1, wherein said hydrophic layer is laminated to said capillary member.

3. A writing instrument as set forth in claim 1, wherein said hydrophobic layer is made of a material selected from the group consisting of:
polypropylese,
polytetrafluoroethylene (PTFE),
expanded polytetrafluoroethylene (ePTFE),
ployvinylidenefluoride (PVDF),
acrylic/nylon, and
hydrophobic polysulfone.

4. A writing instrument, comprising:
(a) an ink reservoir;
(b) a writing tip;
(c) a capillary member for delivering ink from the ink reservoir to the writing tip by means of capillary actions;
(d) a layer of hydrophobic property material covering said capillary member, said hydrophobic layer having first and second ends and a first porosity density allowing transmission of air from the atmosphere through said hydrophobic layer intermediate said first and second ends and into said capillary member while retarding ink contained within said capillary member from passing therethrough said first porosity density being selected with a predetermined value so as to control ink flow through said capillary member with a preselected rate; and
(e) a porous member having a second porosity density, disposed between said capillary member and the atmosphere such that when there is an extra amount of ink flowing out of the ink reservoir not by means of capillary actions said porous member absorbs the extra amount of ink to prevent ink leakage.

5. A writing instrument as set forth in claim 4, wherein said hydrophobic layer is laminated to a first selected portion of said capillary member, and
said porous member is a tubing disposed at a second selected portion of said capillary member intermediate said first selected portion and said ink reservoir.

6. A writing instrument as set forth in claim 4, wherein said hydrophobic layer is made of a material selected from the group consisting of:
polypropylese,
polytetrafluoroethylene (PTFE),
expanded polytetrafluoroethylene (ePTFE),
ployvinylidenefluoride (PVDF),
acrylic/nylon, and
hydrophobic polysulfone.

7. In a writing instrument as set forth in claim 4, 2 wherein ink flow rate controlled by a selection of the first porosity density is further fine adjusted by a selection of the second porosity density.

8. In a writing instrument as set forth in claim 4, wherein said porous member is an open cell type foam.

9. A rolling pen, comprising:
(a) an ink reservoir for storing ink fluid;
(b) a pen tip having a ball point for impressing ink fluid received thereby to a writing surface;
(c) a capillary member for delivering ink fluid from the ink reservoir to said pen tip by means of capillary actions;
(d) a layer of hydrophobic property material covering said capillary member, said hydrophobic layer having first and second ends and a first porosity density allowing transmission of air from the atmosphere through said hydrophobic layer intermediate said first and second ends and into said capillary member while retarding ink contained within said capillary member from passing therethrough, said first porosity density being selected with a predetermined value so as to control ink flow through said capillary member with a preselected rate; and
(e) a porous member having a second porosity density, disposed between said capillary member and the atmosphere such that when there is an extra amount of ink flowing out of the ink reservoir not by means of capillary actions said porous member absorbs the extra amount of ink to prevent ink leakage.

10. A rolling pen according to claim 9, wherein said hydrophobic layer is laminated to a first selected portion of said capillary member, and said porous member is a tubing disposed at a second selected portion of said capillary member intermediate said first selected portion and said ink reservoir.

11. A rolling pen as set forth in claim 9, wherein said hydrophobic layer is made of a material selected from the group consisting of:

polypropylese,
polytetrafluoroethylene (PTFE),
expanded polytetrafluoroethylene (ePTFE),
ployvinylidenefluoride (PVDF),
acrylic/nylon, and
hydrophobic polysulfone.

12. A rolling pen according to claim 9, wherein ink flow rate controlled by a selection of the first porosity density is further fine adjusted by a selection of the second porosity density.

13. A rolling pen according to claim 9, wherein said porous member is an open cell type foam.

14. A writing instrument, comprising:

(a) an ink reservoir;
(b) a writing tip;
(c) an elongated capillary member for delivering ink from the ink reservoir to the writing tip by means of capillary actions;
(d) a layer of a porous hydrophobic property material laminated to a first selected portion of said capillary member, said first selected portion being spaced from said ink reservoir; and
(e) a porous member having a predetermined porosity density, said porous member disposed about a second selected portion of said capillary member intermediate said first selected portion and said ink reservoir such that when there is an extra amount of ink flowing out of the ink reservoir by means other than capillary actions, said porous member absorbs the extra amount of ink to prevent ink leakage.

15. A writing instrument according to claim 14, wherein said porous member provides a means for allowing a predetermined amount of air from the atmosphere to pass through said second selected portion of said capillary member and into the ink reservoir to control the flow rate of ink from said ink reservoir through said capillary member.

16. A writing instrument, comprising:

(a) an ink reservoir;
(b) a writing tip;
(c) an elongated capillary member for delivering ink from the ink reservoir to the writing tip by means of capillary actions;
(d) a layer of a porous hydrophobic property material laminated to a first selected portion of said capillary member, said first selected portion being spaced from said ink reservoir; and
(e) a porous member having a predetermined porosity density, said porous member disposed about a second selected portion of said capillary member intermediate said first selected portion and said ink reservoir such that when there is an extra amount of ink flowing out of the ink reservoir by means other than capillary actions, said porous member absorbs the extra amount of ink to prevent ink leakage;
(f) wherein said layer of hydrophobic property material includes first and second ends and a predetermined porosity density allowing a first predetermined amount of air to pass through said hydrophobic layer intermediate said first and second ends and into said ink reservoir to control the flow rate of ink from said ink reservoir through said capillary member.

17. A writing instrument according to claim 16, wherein said porous member allows a second predetermined amount of air to pass through said second selected portion of said capillary member and into said ink reservoir to control the flow rate of ink from said reservoir through said capillary member.

18. A writing instrument according to claim 17, wherein said porous member is an open cell type foam.

19. A writing instrument according to claim 17, wherein pores of said porous member are larger than pores of said capillary member to prevent ink from flowing into said porous member from said capillary member by capillary actions.

* * * * *